US011821418B2

(12) United States Patent
Dörfler

(10) Patent No.: US 11,821,418 B2
(45) Date of Patent: Nov. 21, 2023

(54) COMPRESSOR WITH SIMPLIFIED BALANCING AND METHOD OF MANUFACTURING SUCH A COMPRESSOR

(71) Applicant: Alfmeier Präzision SE, Treuchtlingen (DE)

(72) Inventor: Erich Dörfler, Landsberg (DE)

(73) Assignee: Alfmeier Präzision SE, Treuchtlingen (DE)

( * ) Notice: Subject to any disclaimer, the term of this patent is extended or adjusted under 35 U.S.C. 154(b) by 48 days.

(21) Appl. No.: 16/833,981

(22) Filed: Mar. 30, 2020

(65) Prior Publication Data

US 2020/0318634 A1 Oct. 8, 2020

(30) Foreign Application Priority Data

Apr. 3, 2019 (DE) ..... 10 2019 108 669.8

(51) Int. Cl.
*F04B 45/047* (2006.01)
*F04B 53/00* (2006.01)

(52) U.S. Cl.
CPC ..... *F04B 45/047* (2013.01); *F04B 53/003* (2013.01)

(58) Field of Classification Search
CPC .... F04B 45/043; F04B 45/047; F04B 53/003; F04B 43/025–026; F04B 43/04; F04B 39/0027
USPC ..... 417/269, 271; 92/13.2, 48, 96–101
See application file for complete search history.

(56) References Cited

U.S. PATENT DOCUMENTS 4,507,058 A * 3/1985 Schoenmeyr ..... F04B 43/026 417/270
4,610,605 A * 9/1986 Hartley ..... F04B 43/026 417/269
4,801,249 A * 1/1989 Kakizawa ..... A61B 5/0235 417/269

(Continued)

FOREIGN PATENT DOCUMENTS

CN 1914784 2/2007
CN 203685529 U * 7/2014

(Continued)

OTHER PUBLICATIONS

German Office Action for application No. DE 102019108669.8, dated Feb. 24, 2022, with English translation.

(Continued)

*Primary Examiner* — Alexander B Comley
(74) *Attorney, Agent, or Firm* — JK Intellectual Property Law, PA

(57) ABSTRACT

A compressor includes a housing with a first and second area; a motor incorporated into the first area and a diaphragm pump unit incorporated into the second area; the diaphragm pump unit including at least one diaphragm body and a drive unit; an armature of the motor being operatively connected to the drive unit through a drive axle; and the diaphragm pump unit having a first imbalance U1 and the motor having a second imbalance U2, wherein the size of the second imbalance U2 is designed in such a way that the sum of the first imbalance U1 and the second imbalance U2 in the system consisting of the motor and the drive unit coupled with the drive axle statically and dynamically results in zero. A related method for manufacturing the compressor is also disclosed.

12 Claims, 2 Drawing Sheets

(56) References Cited

U.S. PATENT DOCUMENTS

| | | | | |
|---|---|---|---|---|
| 5,230,616 | A * | 7/1993 | Serizawa | F04C 29/0021 29/888.024 |
| 5,711,652 | A * | 1/1998 | Van De Venne | B29C 65/0672 415/199.1 |
| 5,738,503 | A * | 4/1998 | Schmidt-Marloh | H02K 15/165 417/423.7 |
| 6,382,928 | B1 * | 5/2002 | Chang | F04B 45/027 417/269 |
| 6,716,005 | B2 | 4/2004 | Yamakawa | |
| 6,843,643 | B2 * | 1/2005 | Fukami | F04B 43/026 417/413.1 |
| 7,377,756 | B2 * | 5/2008 | Hori | F04B 45/043 417/413.1 |
| 7,426,858 | B2 * | 9/2008 | Otten | H02K 15/165 73/459 |
| 7,520,734 | B2 * | 4/2009 | Luedtke | F04D 29/662 417/423.1 |
| 7,819,636 | B2 * | 10/2010 | Huang | F04B 45/022 417/269 |
| 8,596,992 | B2 * | 12/2013 | DeDecker | F04B 27/053 417/273 |
| 9,217,425 | B2 * | 12/2015 | Looi | F04B 45/043 |
| 9,702,377 | B2 * | 7/2017 | Wykman | B60N 2/914 |
| 9,784,264 | B2 * | 10/2017 | Krebs | F04B 45/047 |
| 2005/0025651 | A1 * | 2/2005 | Sowa | F04C 18/0207 418/150 |
| 2008/0292484 | A1 | 11/2008 | Suh et al. | |
| 2010/0101407 | A1 * | 4/2010 | Lynn | F04B 27/1063 91/505 |

FOREIGN PATENT DOCUMENTS

| | | | |
|---|---|---|---|
| CN | 203685529 | U | 7/2014 |
| CN | 205089621 | U | 3/2016 |
| CN | 206816477 | U | 12/2017 |
| DE | 10247293 | A1 | 5/2003 |
| DE | 102 59 179 | A1 | 7/2004 |
| DE | 195 01 959 | A1 | 7/2004 |
| DE | 10 2013 207 741 | A1 | 10/2014 |
| EP | 0936355 | A2 | 8/1999 |
| EP | 2112377 | A2 | 10/2009 |
| KR | 20180103270 | A * | 9/2018 |

OTHER PUBLICATIONS

German Office Action for Application No. 10 2019 108 669.8, dated Dec. 13, 2019, with English Translation.

Chinese Office Action dated Nov. 9, 2021.

Chinese Office Action dated Aug. 1, 2022, for application No. 202010244193.0, with English translation.

* cited by examiner

COMPRESSOR WITH SIMPLIFIED BALANCING AND METHOD OF MANUFACTURING SUCH A COMPRESSOR

CROSS-REFERENCE TO RELATED APPLICATIONS

This application claims benefit to German Patent Application Number 10 2019 108 669.8, filed Apr. 3, 2019, which is incorporated in its entirety by reference herein.

TECHNICAL FIELD

The disclosure relates to a compressor, especially a diaphragm pump, and to a method for manufacturing such a compressor.

BACKGROUND

A diaphragm pump is known, for example, from EP 2 112 377 A2. The known pump includes a motor and a drive unit with at least one swash plate, which periodically compresses a diaphragm body. In such a pump, the motor is typically balanced, so that the motor lacking the drive unit has no imbalance.

It is furthermore known that the drive unit can be balanced, for example, with an eccentric in such a way that the drive unit, when considered separately, has no imbalance. However, when such a pump is operated, vibrations are generated when the diaphragm body is compressed.

It is furthermore known from EP 2 654 511 that pump vibrations occurring outside of a housing, especially when used in vehicle seats, disturb the user acoustically or due to the movement as such, are reduced by springs arranged between motor unit and housing. Such an incorporation of springs in pumps, however, increases the weight, enlarges the housing (i.e. the space needed when incorporating them in a vehicle seat, for example) and increases the cost of such a pump.

FIG. 1 shows a compressor 2 according to the state of the art. The compressor 2 includes a housing 4 with a first area 6 in which a motor 10 is incorporated and a second area 8 in which a diaphragm pump unit 12 is incorporated. The housing 4 can be executed as one single piece. Alternately, the first area 6 is executed as a first partial housing and the second area 8 as a second partial housing. The two partial housings are connected to each other. The motor 10 includes one armature 30, magnets 32 and brushes 34. The diaphragm pump unit 12 includes two diaphragm bodies 22 and one drive unit 14. The drive unit 14 is connected to the motor 10 through the drive axle 18. The drive unit 14 includes one eccentric 24, which connects the drive axle 18 to a swash plate axle 20, wherein the swash plate axle 20 and the drive axle 18 are inclined to each other by an angle $\alpha$. The swash plate axle 20 powers a swash plate 16, which alternately compresses the diaphragm body 22. The eccentric 24 can optionally be equipped with a weight 26, which is spherical here. According to the state of the art, both the armature 30 and the drive unit 14 are balanced, but the overall compressor has a dynamic imbalance.

SUMMARY

A purpose of the disclosure is to eliminate the disadvantage according to the state of the art. In particular, a compressor and a method for producing such a statically and dynamically balanced compressor should be indicated.

The compressor according to the disclosure includes a housing with a first area and a second area, wherein a compressor motor is incorporated into the first area and a diaphragm pump unit of the compressor is incorporated into the second area, wherein the diaphragm pump unit includes at least one diaphragm body and one drive unit, wherein an armature of the motor is operatively connected to the drive unit via a drive axle, wherein the drive unit has a first imbalance and the motor a second imbalance, wherein the size of the second imbalance is designed in such a way that the sum of the first imbalance and of the second imbalance in the system consisting of motor and drive unit coupled with the drive axle results statically and dynamically in zero or at least almost zero. The second imbalance can be especially generated by second weights locally added (e.g. affixed) to the armature of the motor or locally inserted depressions, thereby changing the distribution of masses with regard to the balanced motor. Likewise, the first imbalance can take place by locally adding first weights or a local weight reduction. In case of the drive axle, it can be especially a motor shaft. The drive unit expediently includes a swash plate, a swash plate axle, and an eccentric. The eccentric is expediently connected to the drive axle and the swash plate axle. The eccentric has expediently at least one weight.

The housing can be executed as one single piece. Alternately, the housing includes a first partial housing (which can be the motor housing itself) as first area and a second partial housing for the diaphragm pump unit. The first and second partial housing are then connected to one another.

The compressor according to the disclosure is also dynamically balanced so no disturbing vibrations are generated and thus suspensions do not have to be installed or they can be at least executed in a considerably easier way. The compressor according to the disclosure is particularly suitable for incorporation in vehicle seats for seating comfort functions, e.g. lumbar supports.

In the embodiment, the imbalance of the motor is generated at least by a milled groove on the motor armature. Such a milled groove is especially arranged in a largely cylindrical armature of the motor. The milled groove can extend perpendicularly or parallel to the drive axle. For easier naming, the extension direction of the drive axle will hereinafter be named z-axis. An x-axis and a y-axis form an orthogonal coordinate system to the z-axis.

Expediently, the compressor has on the armature of the motor at least two milled grooves, arranged on opposite sides with regard to an x-axis and/or a y-axis and/or a z-axis. Thus, for example, a first milled groove is arranged on a side of the cylindrical armature that faces the drive unit and a second milled groove on a side of the cylindrical armature that faces away from the drive unit, wherein the first milled groove and the second milled groove cut a plane that includes the drive axle.

The drive unit includes a swash plate, a swash plate axle and an eccentric, wherein the eccentric is connected to the drive axle and the swash plate axle, wherein the eccentric has at least one weight. The drive axle and the swash plate axle have especially an angle $\alpha$ to one another.

In particular, the eccentric has two weights opposite one another, parallel to the drive axle and expediently spaced apart.

The weight or weights can be spherical and/or incorporated into the eccentric. In the embodiment, the weights can be designed to be screwed in the eccentric. Alternately, the weights can also be executed as one single piece with the eccentric.

The method according to the disclosure for manufacturing a compressor according to the disclosure includes the following steps:

Provision of a balanced motor,

Provision of a balanced drive unit and connection to the motor,

Determination of the dynamic imbalance of a system consisting of motor and diaphragm pump unit, which contains the drive unit, and Generation of a first and second imbalance U1 and U2 that dynamically and statically balance themselves out.

The drive unit expediently includes one swash plate, one swash plate axle, and one eccentric. The eccentric is expediently connected to the drive axle and the swash plate axle that expediently has at least one weight.

The generation of the second imbalance U2 can especially take place by means of a balancing machine, in which an imbalance U2 is entered as target value. The imbalance U2 depends on the position and size of milled grooves or additional weights.

The determination of the dynamic imbalance can take place in tests performed with structurally identical systems consisting of motor and diaphragm pump unit. Alternately, the dynamic imbalance can be determined with a simulation.

In this context, the generation of a second imbalance—especially the insertion of at least one milled groove in the armature—is what compensates for the dynamic imbalance. To create the milled groove, a balancing machine in which the second imbalance U2 is entered as target value, can be especially used.

In another embodiment, the method includes the determination of a residual imbalance in compressors manufactured according to the method and the consideration of the residual imbalance for setting the target value.

BRIEF DESCRIPTION OF THE DRAWINGS

The disclosure will now be explained in more detail with reference to the enclosed drawings, which show.

DETAILED DESCRIPTION

Figure 1:
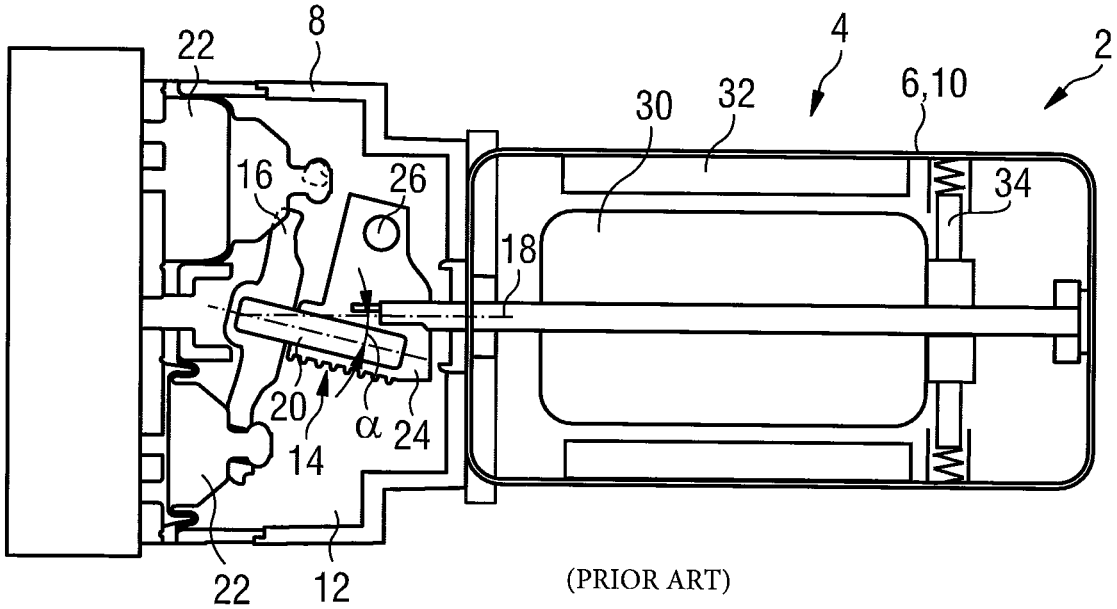
FIG. 1 is a side diagrammatical view of a compressor according to the state of the art.
Figure 2:
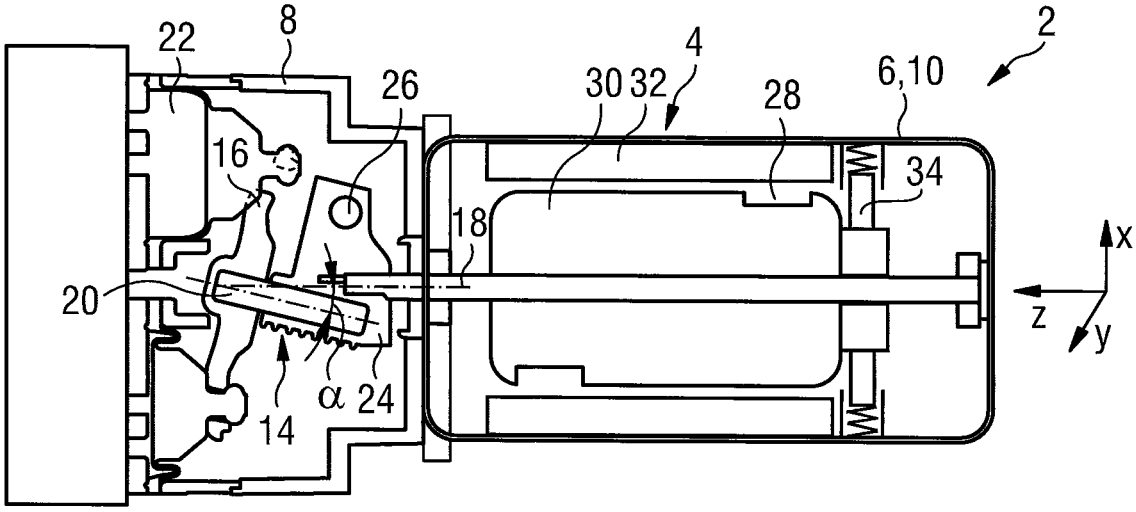
(PRIOR ART) FIG 2
FIG. 2 is a diagrammatical side view of a first embodiment of a compressor according to the present disclosure.

FIG. 2 shows a compressor 2 according to the disclosure that differs from the compressor 2 shown in FIG. 1 especially in that milled grooves 28 have been inserted in the armature of the motor 30. With regard to the x-axis, the two milled grooves 28 shown here are arranged on opposite sides. Moreover, the milled grooves are arranged offset along the z-axis, especially symmetrically with regard to the center of the motor. Elements and reference numerals common to the devices of FIGS. 1 and 2 are not repeated herein for brevity.

Figure 3A:
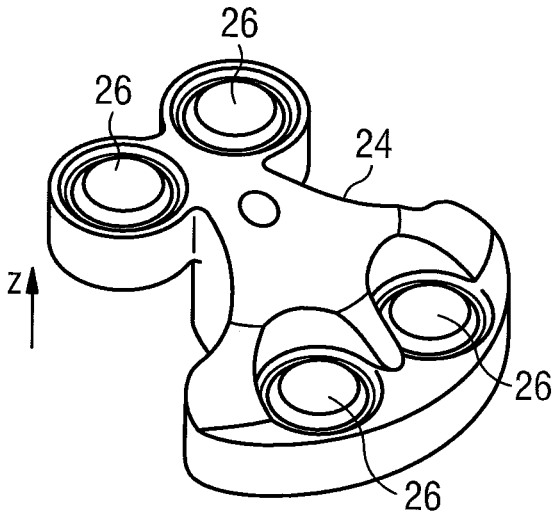
FIGS. 3*a* and 3*b* are respective top and bottom isometric views of a first embodiment of an eccentric useful with the compressor.
Figure 3B:
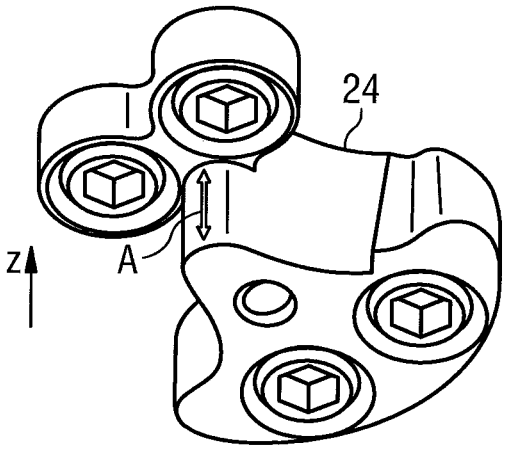
Figure 4A:
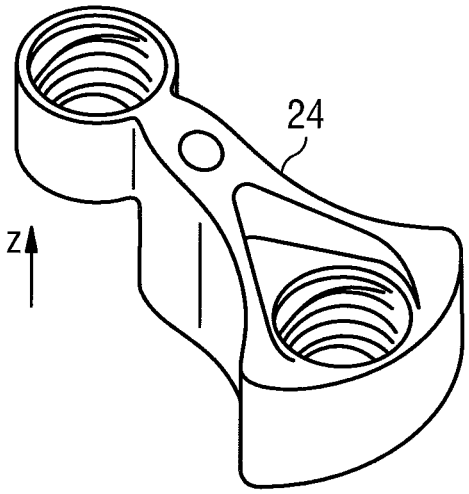
FIGS. 4*a* and 4*b* are respective top and bottom isometric views of a second embodiment of an eccentric with the compressor.
Figure 4B:
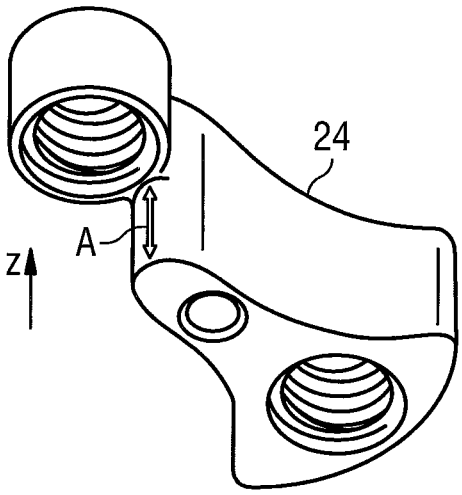

FIGS. 3*a*, 3*b*, 4*a*, and 4*b* show embodiments of the eccentric 24. FIG. 3*a* shows a top view of an eccentric 24 of a first embodiment, FIG. 3*b* the corresponding view from below. The eccentric 24 has a drilled hole on the top and bottom, dimensioned in each case to receive the drive axle 18 or the swash plate axle 20. A plane running through the axes of the two drill holes forms a symmetry plane of the eccentric. Furthermore, the eccentric 24 has four weights 26, executed here as screw-in weights. Along the z-axis, the weights 26 are kept at a distance A to one another. FIGS. 4*a* and 4*b* show a top view of an embodiment of the eccentric 24 and a view from below. In this embodiment, threaded holes for placing two screw-type weights 26 are provided, which are also at a distance A to one another along the z-axis. An imbalance can be selectively achieved by the screw-type weights.

LIST OF REFERENCE SIGNS

2 Compressor
4 Housing
6 First area
8 Second area
10 Motor
12 Diaphragm pump unit
14 Drive unit
16 Swash plate
18 Drive axle
20 Swash plate axle
22 Diaphragm body
24 Eccentric
26 Weight
28 Milled groove
30 Armature
32 Magnet
34 Brush
A Distance
U1 First imbalance
U2 Second imbalance
$\alpha$ Angle

The invention claimed is:

1. A compressor comprising:

a housing with a first area and a second area;

a motor incorporated into the first area and a diaphragm pump unit incorporated into the second area;

the diaphragm pump unit including at least one diaphragm body and a drive unit, the drive unit including a swash plate, an eccentric, and a swash plate axle having a first end joined to the swash plate and a second end joined to the eccentric;

the motor including an armature and a drive axle, the armature being joined to the drive axle for rotation therewith, the drive axle having an end operatively connected to the eccentric so that rotation of the drive axle rotates the eccentric, the swash plate axle, and the swash plate around a central axis of the drive axle;

rotation of the drive unit around the central axis defining a first imbalance U1, and rotation of the armature and drive axle around the central axis defining a second imbalance U2, wherein a size of the second imbalance U2 is designed in view of the first imbalance U1 in such a way that a sum of the first imbalance U1 and the second imbalance U2 in a system consisting of the diaphragm pump unit and the motor statically and dynamically results in zero;

wherein the second imbalance U2 is generated by at least two milled grooves on the armature or by placing at least two local weights on the armature.

2. The compressor according to claim 1, wherein the eccentric has at least one weight.

3. The compressor according to claim 2, wherein the eccentric has two weights, wherein the weights of the eccentric are arranged opposite one another with regard to the drive axle.

4. The compressor according to claim 3, wherein the weights of the eccentric are arranged parallel to the drive axle, the weights being arranged at a distance A from each other.

5. The compressor according to claim 2, wherein the at least one weight of the eccentric is spherical.

6. The compressor according to claim 2, wherein the at least one weight of the eccentric is incorporated into the eccentric.

7. The compressor according to claim 2, wherein the at least one weight of the eccentric is configured to be screwed into the eccentric.

8. The compressor according to claim 2, wherein the at least one weight of the eccentric is integrally formed with the eccentric.

9. A method for manufacturing a compressor according to claim 1 comprising the following steps:

providing the diaphragm pump unit having the first imbalance U1;

providing the motor;

connecting the eccentric to the drive axle to thereby connect the motor to the drive unit;

determining the dynamic imbalance of the motor and the drive unit in a connected state; and generating the second imbalance U2.

10. The method according to claim 9, wherein the dynamic imbalance is determined in tests performed on the compressor according to claim 1 or with a simulation.

11. The method according to claim 9, further including the steps of:

determining a residual imbalance on at least one compressor manufactured according to the method before designing the second imbalance U2; and setting the second imbalance U2 as a target value using the residual imbalance.

12. The compressor according to claim 1, wherein the at least two milled grooves or the at least two local weights are arranged on opposite sides of the armature with regard to at least one of an x-axis, a y-axis, and a z-axis.

* * * * *